United States Patent [19]

MacAvoy

[11] 4,387,945

[45] Jun. 14, 1983

[54] ELECTRICAL CONNECTOR INSERT

[75] Inventor: David W. MacAvoy, Bainbridge, N.Y.

[73] Assignee: The Bendix Corporation, Southfield, Mich.

[21] Appl. No.: 279,275

[22] Filed: Jun. 30, 1981

[51] Int. Cl.[3] ..... H01R 13/42

[52] U.S. Cl. ..... 339/59 R

[58] Field of Search ..... 339/59 R, 59 M, 217 S

[56] References Cited

U.S. PATENT DOCUMENTS

| | | | |
|---|---|---|---|
| 3,068,443 | 12/1962 | Nava et al. | 339/59 M |
| 3,158,424 | 11/1964 | Bowen . | |
| 3,165,369 | 1/1965 | Maston . | |
| 3,221,292 | 11/1965 | Swanson et al. . | |
| 3,470,525 | 9/1969 | Jaaksoo et al. | 339/217 S |
| 3,475,720 | 10/1969 | Culver | 339/217 S |
| 3,812,447 | 5/1974 | Eifler et al. | 339/59 R |
| 3,824,681 | 7/1974 | Clark | 339/90 C |
| 4,082,398 | 4/1978 | Bourdon et al. | 339/59 M |

*Primary Examiner*—Mark Rosenbaum

*Attorney, Agent, or Firm*—Raymond J. Eifler

[57] ABSTRACT

An electrical connector insert (10) for releasably retaining a plurality of contacts (30) in each passage (15) extending through the insert (10). Each of the passages (15) in the insert include an annular member (20) which has an arcuate surface (21) that engages an annular groove (31) in a contact (30). The contact (30) may be inserted from the front or rear of the connector and removed from the front or rear of the connector.

2 Claims, 3 Drawing Figures

ELECTRICAL CONNECTOR INSERT

This invention relates to electrical connectors and more particularly to an electrical connector insert within the connector that retains the electrical contacts.

Electrical connectors generally include a plug and a receptacle, each of which has an insert of dielectric material provided with multiple openings within which electrical contacts are releasably retained. Examples of electrical connectors that have rear releasable and rear removable contacts may be found in U.S. Pat. No. 3,165,369 issued Jan. 12, 1965 and entitled, "Retention System for Electrical Contacts"; U.S. Pat. No. 3,158,424 issued Nov. 24, 1964 and entitled, "Contact Mounting"; U.S. Pat. No. 3,824,681 issued July 23, 1974 and entitled, "Method of Providing a Coupling for Electrical Connectors and the Like"; and U.S. Pat. No. 3,812,447 issued May 1, 1974 and entitled "Rear Release Contact Retention Assembly". Connectors of this type allow contacts to be removed from the rear of a connector while it is still connected to another connector. An example of another type of electrical connector that has front releasable and front removable contacts as well as rear releasable and rear removable contacts may be found in U.S. Pat. No. 4,082,398 issued Apr. 4, 1978 and entitled, "Electrical Connector with Front and Rear Insertable and Removable Contacts". Finally, an example of an electrical connector of the type having front releasable and rear removable contacts may be found in U.S. Pat. No. 3,221,292 issued Nov. 30, 1960 and entitled, "Electrical Connector".

None of the foregoing connectors provide a connector that can retain a contact that does not have an enlarged middle portion with shoulders.

DISCLOSURE OF THE INVENTION

This invention provides an insert for an electrical connector that has snap in contacts.

The invention is an electrical connector having an insert comprised of a body of dielectric material having a plurality of passages that are adapted to receive and releasable retain respective electrical contacts that have an annular groove. The connector insert is characterized by a resiliently and outwardly deflectable annular member that has an arcuate surface located in each passage to engage the groove and retain the contact. The contact may be removed from the connector insert by an apppropriate tool that deflects the member and releases the contact for removal.

One advantage of this invention is that it provides a new approach to releasably retaining contacts of an electrical connector.

DETAILED DESCRIPTION OF THE INVENTION

Figure 1:
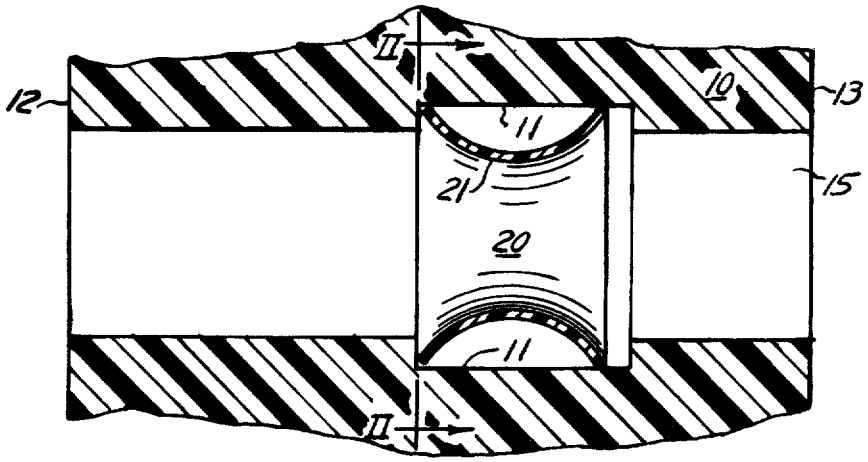
FIG. 1 is a partial diagrammatic view of an insert incorporating the principles of the invention.

Referring now to the drawings, FIG. 1 is a partial view of electrical connector insert 10 illustrating one of a plurality of passages 15 that extends from a front face 12 to a rear face 13 of the insert 10. Each passage 15 includes an annular groove 11 having mounted therein an annular member 20. The annular member 20 may be comprised of any resiliently deformable material such as plastic or a resiliency deflectable material such as spring steel so that the annular member 20 may be snapped into the groove 11 and provide an arcuate surface 21 extending radially inwardly and axially of the passage 15. Preferably the annular member is a metal which will expand axially in groove 11 when a radial force is applied against the arcuate surface 21. When such a force is applied by a tubular contact removal tool, the inner diameter of the annular member increases as the member 20 is deflected outwardly to release a contact (not shown).

Figure 2:
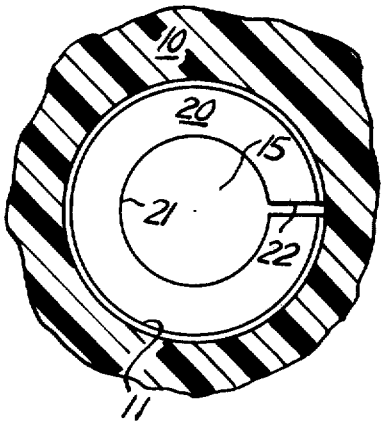
FIG. 2 is a cross-sectional view of the insert taken along lines II—II of FIG. 1.

FIG. 2 illustrates a view of the annular member 20 taken along lines II—II of FIG. 1. The annular member 20 has an axial split 22 so that the annular member 20 may be snapped into place in the groove 11 in the insert 10. A contact, having a diameter slightly larger than the diameter formed by the arcuate surface 21, passing into the passage 15 will axially lengthen and outwardly deflect annular member 20.

Figure 3:
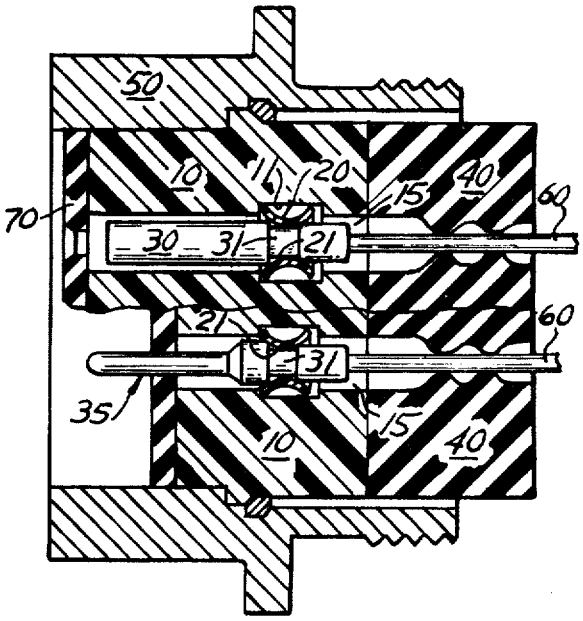
FIG. 3 is an electrical connector incorporating the principles of this invention.

FIG. 3 illustrates an electrical connector assembly comprising: an outer metal shell 50; a rear moisture sealing grommet 40 generally comprised of rubber; an interfacial seal 70, which is also generally comprised of rubber; a plastic contact retaining insert 10; and a plurality of contacts 30, 35 mounted in the contact retaining insert 10.

FIG. 3 illustrates how a contact 30, 35 having an annular groove 31 therein is retained in the insert 10 by the arcuate surface 21 which extends into the groove 31 in the contact 30, 35.

To remove a contact 30, 35 from the rear of the insert 10 it is only necessary to insert an appropriate tool to deflect outwardly the arcuate surface 21 until it disengages the groove 31 in the contact 30, allowing the contact 30 to be removed from the passage 15.

Similarly, the contact 30, 35 may be inserted into the rear of the passage 15 by pushing the contact into the passage 15 where it will deflect the arcuate surface 21 outwardly until it reaches the annular groove 31 in the contact 30 where the arcuate surface 21 will snap into place in the groove 31, thereby releasably retaining the contact 30, 35.

Alternately, should it be desirable to remove the contact 30, 35 from the front of the connector insert 10, an appropriate tool is used to release the contact and push the contact 30 forwardly to expand the opening in the interfacial seal 70 and allow the contact 30 to pass out of the front of the connector.

While a preferred embodiment of the invention has been disclosed, it will be apparent to those skilled in the art that changes may be made to the invention as set forth in the appended claims and, in some instances, certain features of the invention may be used to advantage without corresponding use of other features. For instance, the annular member 20, instead of being a separate member, may be molded as an integral part of the insert 10. Accordingly, it is intended that the illustrative and descriptive materials herein be used to illustrate the principles of the invention and not to limit the scope thereof.

Having described the invention what is claimed is:

1. In combination with an electrical connector having removable contacts, said connector of the type having: a housing; a plurality of contacts, each contact having a rear portion, a forward mating portion, and a middle portion; and means for releasably mounting said contacts in said housing, the improvement wherein the means for releasably mounting said contacts includes:

an annular groove in the middle portion of each of said contacts;

an insert having a plurality of bores each having a respective contact therein said insert including an annular groove in each of said bores; and an annular member mounted in each of said grooves in said insert bore, each of said members extending radially inwardly and having an annular arcuate surface extending around the groove in a respective bore and axially of said passage, said member resiliently and radially deflectable and adapted to snap into the groove in a respective contact whereby, when a contact is inserted into said passage said annular member snaps into the groove in said contact to retain said contact in said insert.

2. The combination recited in claim 1 wherein said annular member is comprised of metal and has an axial split therein.

* * * * *